US006511224B1

(12) United States Patent
Lu et al.

(10) Patent No.: US 6,511,224 B1
(45) Date of Patent: Jan. 28, 2003

(54) HEAT REMOVAL FROM HIGH POWER CT X-RAY TUBES USING HEAT BUFFER AND REFRIGERATION TECHNIQUES

(75) Inventors: Qing Kelvin Lu, Aurora, IL (US); Gerald J. Carlson, Aurora, IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 6 days.

(21) Appl. No.: 09/691,015

(22) Filed: Oct. 18, 2000

(51) Int. Cl.[7] ..... H01J 35/10
(52) U.S. Cl. ..... 378/199; 378/141
(58) Field of Search ..... 378/119, 127, 378/130, 141, 200, 199, 201, 202

(56) References Cited

U.S. PATENT DOCUMENTS 4,780,901 A * 10/1988 Gabbay et al. ..... 378/141
5,012,505 A * 4/1991 Zupancic et al.
5,086,449 A 2/1992 Furbee et al.
5,299,249 A 3/1994 Burke et al.
5,551,249 A * 9/1996 Van Steenburgh, Jr. .... 62/196.4
5,610,968 A * 3/1997 Deucher et al. ..... 378/199
6,318,100 B1 * 11/2001 Brendel et al. ..... 62/217

FOREIGN PATENT DOCUMENTS

DE 199 45 416 4/2001
JP 2001185396 7/2001

* cited by examiner

*Primary Examiner*—Robert H. Kim
*Assistant Examiner*—Hoon K. Song
(74) *Attorney, Agent, or Firm*—Fay, Sharpe, Fagan, Minnich & McKee, LLP

(57) ABSTRACT

A cooling oil circuit (D) circulates cooling oil over an x-ray tube absorbing its waste heat. A refrigeration circuit (E) then cools the cooling oil. A heat buffer (52) absorbing peak heat loads from the cooling fluid when the x-ray tube is generating x-rays. Valves (58, 60) regulate a relative amount of cooling oil entering the heat buffer to increase heat transfer efficiency. The heat buffer enables the system to handle peak heat loads with a smaller, more condensed refrigeration system, by absorbing heat during operation of the x-ray tube and releasing heat between operations.

15 Claims, 2 Drawing Sheets

HEAT REMOVAL FROM HIGH POWER CT X-RAY TUBES USING HEAT BUFFER AND REFRIGERATION TECHNIQUES

BACKGROUND OF THE INVENTION

The present invention relates to the radiographic arts. It finds particular application in conjunction with computerized tomographic (CT) scanners and will be described with particular reference thereto. However, it is to be appreciated that the present invention will also be amenable to other diagnostic x-ray applications.

Generally, CT scanners have included a floor-mounted frame assembly which remains stationary during a scan and a rotatable frame assembly mounted therein. An x-ray tube is mounted to the rotatable frame assembly which rotates around a patient receiving examination region during the scan. Radiation from the x-ray tube traverses the patient receiving region and impinges upon an array of radiation detectors. Using the position of the x-ray tube during each sampling, a tomographic image of one or more slices through the patient is reconstructed.

The x-ray tube assembly includes a housing within which a rotating anode x-ray tube is mounted. High voltage and control leads pass through the housing to the tube. During x-ray generation, electrons are emitted from a heated filament in the cathode and accelerated to a focal spot area on the anode. Upon striking the anode, the focal spot is heated white hot to excite the emission of x-rays. Some portion of the electrons, or secondary electrons, strike the surrounding housing and are converted into undesirable waste heat. In fact, most of the energy applied to an x-ray tube is converted to heat. One of the persistent problems in CT scanners and other radiographic apparatus is effectively and efficiently dissipating the waste heat created while generating x-rays.

In order to remove the waste heat, a cooling oil is circulated between the housing and the x-ray tube. The oil is typically drawn from an output aperture located at one end of the housing, circulated through a heat exchanger on the rotating gantry and returned to an inlet aperture in the opposite end of the housing. The returned, cooled fluid flows axially through the housing toward the outlet aperture, absorbing heat from the x-ray tube. Transferring the heat removed by the heat exchanger from the rotating gantry is logistically difficult. The cooling of the x-ray tube is crucial to the life and quality of the tube. With the increasing demand of higher power CT x-ray tubes, the issue of cooling has become even more important and more difficult.

The power applied to an x-ray tube generally follows a designated duty cycle. As a result, the amount of the heat dissipation rate from the x-ray tube changes cyclically. To ensure sufficient cooling, an x-ray tube cooling system is generally designed based on the peak value of the heat dissipation received by the system. Thus, the volume of the cooling system may be unnecessarily large, but permitting the x-ray tube to become too hot during operation can irreversibly damage an expensive x-ray tube.

The present invention provides a new and improved cooling system for overcoming the above-reference drawbacks and others.

SUMMARY OF THE INVENTION

The present invention relates to an improved cooling system and method for effective and efficient removal of waste heat from a CT scanner.

In accordance with one aspect of the present invention, a diagnostic imaging system comprises an x-ray tube, an x-ray detector disposed across an imaging region from the x-ray tube, a cooling oil circuit which circulates cooling oil over the x-ray tube to remove heat form the x-ray tube, and a second cooling circuit which removes heat form the cooling oil circuit at a heat removal rate that is less than a heat generation rate of the x-ray tube.

In accordance with another aspect of the present invention, a cooling system for an x-ray tube of a diagnostic scanner is provided. The system comprises a cooling fluid that is in thermal contact with an x-ray tube and absorbs heat from the x-ray tube. The system also comprises a heat buffer which receives the cooling fluid after absorbing heat from the x-ray tube and a refrigeration system in thermal contact with the cooling fluid. The heat buffer contains a high heat capacity material in thermal contact with the cooling fluid passing therethrough. The refrigeration system removes heat from the cooling fluid before the cooling fluid returns to the x-ray tube.

In accordance with another aspect of the present invention, a radiographic cooling method is provided. The x-ray tube is intermittently operated to generate x-rays and heat. The heat generated by the x-ray tube is absorbed with a cooling fluid. A portion of the heat from the cooling fluid is absorbed in a heat buffer while the x-ray tube is generating x-rays and heat. The heated cooling fluid is cooled and the cooled cooling fluid is recirculated to the x-ray tube.

One advantage of the present invention resides in its ability to handle peak heat loads during the generation of x-rays, yet reduce the size of the heat retraction system needed to cool the cooling fluid.

Another advantage of the present invention is that it increases the efficiency of the system.

Another advantage of the present invention resides in its compactness, freeing valuable space on the rotating gantry.

Still other advantages and benefits of the invention will become apparent to those skilled in the art upon a reading and understanding of the following detailed description.

BRIEF DESCRIPTION OF THE DRAWINGS

The invention may take form in various components and arrangements of components, and in various steps and arrangements of steps. The drawing is only for purposes of illustrating a preferred embodiment and is not to be construed as limiting the invention.

DETAILED DESCRIPTION OF THE PREFERRED EMBODIMENT

Figure 1:
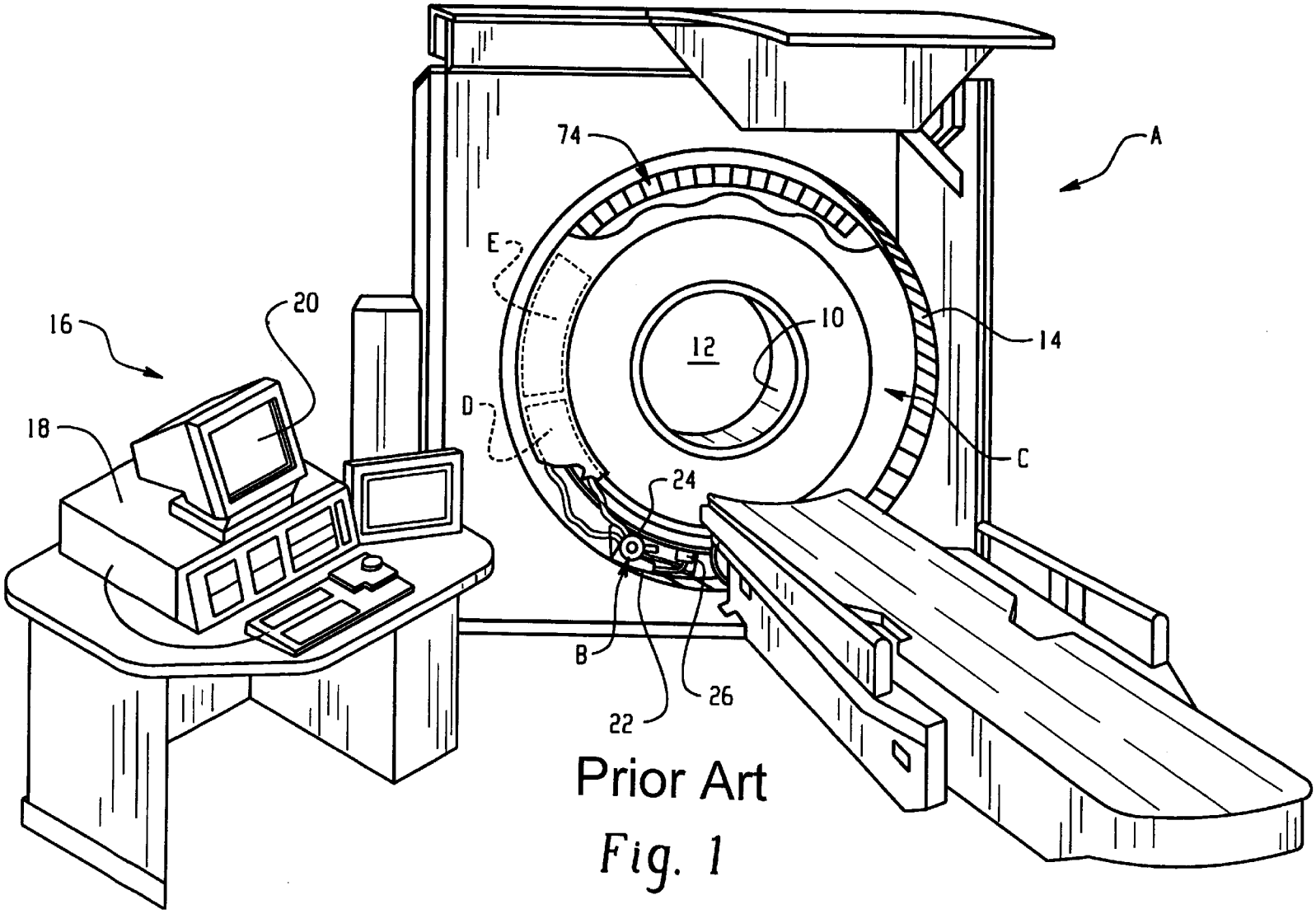
Prior Art Fig. 1
FIG. 1 is a diagrammatic illustration of a CT scanner in accordance with the present invention.

With reference to FIG. 1, a CT scanner includes a floor mounted or stationary frame portion A whose position remains fixed during data collection. An x-ray tube assembly B is mounted on a rotating frame C rotatably mounted within the stationary frame portion A. The stationary frame portion A includes a cylinder 10 that defines a patient receiving examination region 12 therein. An array of radiation detectors 14 are disposed concentrically around the patient receiving region 12. The stationary frame A with the rotating frame C can be canted or tipped to scan slices at selectable angles.

A control console 16 contains an image reconstructing processor 18 for reconstructing an image representation from output signals from the detector array 14. A monitor 20 converts the reconstructed image representation into a human readable display. The console 16 also includes appropriate digital recording media for archiving image representations, performing image enhancements, and the like. Various control functions, such as initiating a scan, selecting among different types of scans, calibrating the system, and the like are also performed at the control console 16.

The x-ray tube assembly B includes a housing 22 having an x-ray permeable window 24 directed toward the, patient receiving region 12. A rotating anode x-ray tube is mounted in the housing 22. High voltages, on the order of 150 kV and higher applied between the rotating anode and a cathode accelerate electrons from the cathode to the anode. The energy from the electrons striking the anode generates x-rays and a large amount of heat.

The x-rays pass through the x-ray permeable window 24 and across the patient receiving region 12. Appropriate x-ray collimators focus the radiation into one or more planar beams which span the examination region 12, as is conventional in the art. Other equipment associated with the x-ray tube B, such as a high voltage power supply 26, are also mounted on the rotating frame C. The high voltage power supply 26 provides the necessary high voltages to the anode and the cathode.

Figure 2:
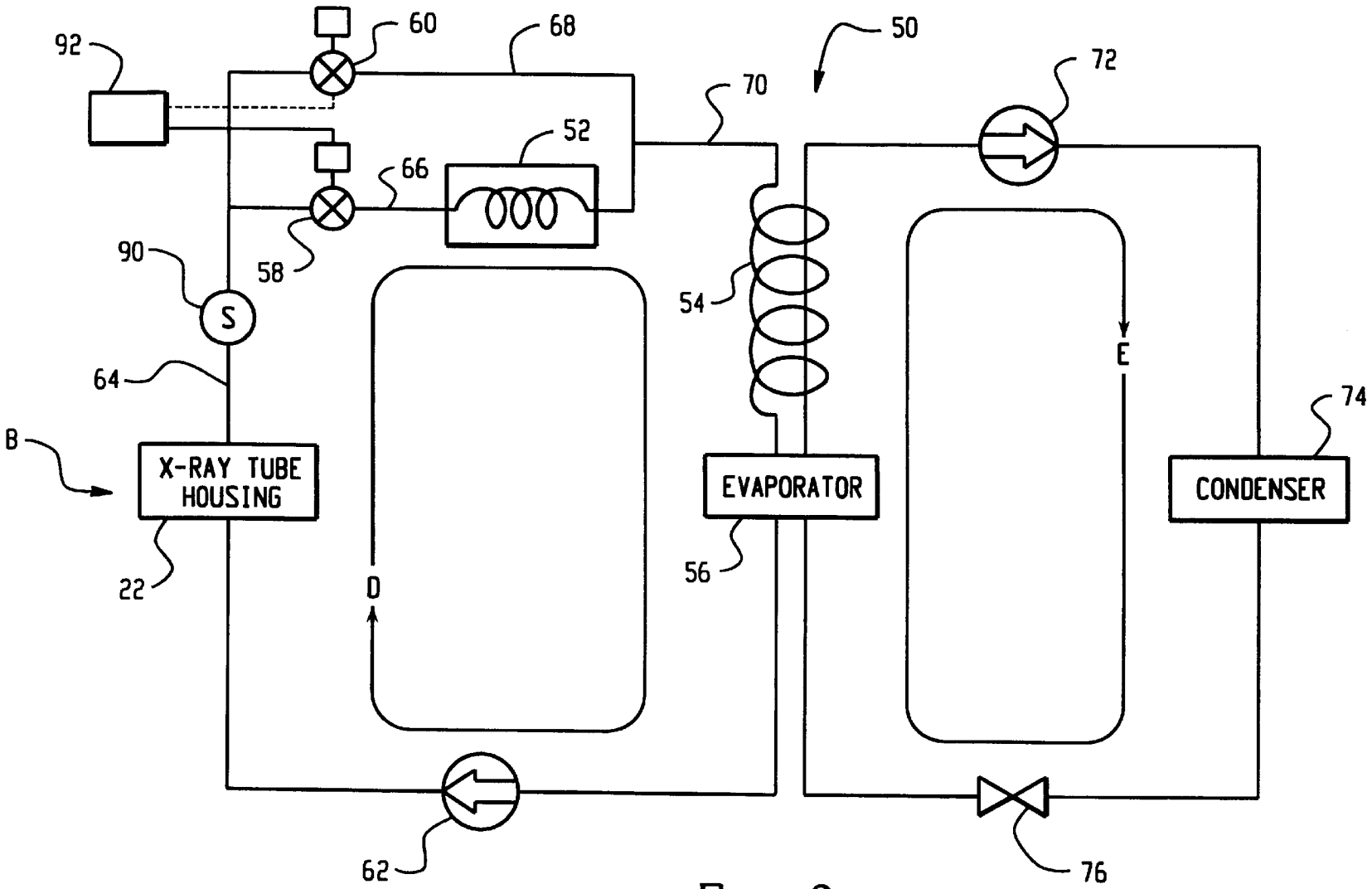
FIG. 2 is a cooling system schematic for the removal of heat from an x-ray tube of a CT scanner.

With particular reference to FIG. 2, the undesirable heat generated by the x-ray tube B is removed by circulating a cooling fluid, such as oil, water, sulphur, hexafluoride and other liquids and gasses, through the housing 22 around the x-ray tube. More specifically, cooling fluid enters the housing 22 through an inlet aperture, absorbs heat from the x-ray tube, and the heated cooling fluid exits the housing 22 through an outlet aperture. A cooling system 50 is used to recirculate and continuously provide the cooling fluid at a desired temperature to the housing 22.

The cooling system 50 comprises a cooling oil or fluid loop D for circulating cooling fluid at a desired temperature to the x-ray tube B and a refrigeration loop E for maintaining the cooling fluid of the cooling fluid loop D at the desired temperature. The cooling fluid loop D includes a heat buffer 52, a precooler/superheater 54, an evaporator 56, heat buffer valve 58, a bypass valve 60, and an cooling fluid pump 62.

From the outlet aperture on the x-ray tube assembly, the cooling fluid enters a outlet conduit 64 which splits into heat buffer conduit 66 and the bypass conduit 68. The heat buffer conduit 66 fluidly communicates with the heat buffer 52 and has heat buffer valve 58 disposed therein. The bypass conduit 68 includes the bypass valve 60 disposed therein. Any fluid allowed to pass through the valves 58, 60 eventually flows into a merging conduit 70. Thus, if both the valves 58, 60 are open, one stream of cooling fluid flows through the heat buffer valve 58 and the heat buffer 52 into merging conduit 70 and the other fluid stream flows through the bypass valve 60 into merging conduit 70.

The precooler/superheater 54 is in fluid communication between the merging conduit 70 and the evaporator 56. Specifically, the precooler/superheater 54 is located downstream of the merging conduit 70 and upstream of the evaporator 56. The evaporator 56 is upstream of, and in fluid communication with, the pump 62 which fluidly communicates with the x-ray tube housing through the inlet aperture.

The heat buffer 52 includes a cavity containing a high heat capacity fluid such as water, liquid metal, or other suitable heat sink. A tubular passage through the cavity of the heat buffer 52 has a large surface area to allow the cooling fluid of the cooling fluid loop D to transfer heat readily to and from the heat buffer 52. Preferably, parallel tubes include a plurality of fins disposed about their peripheral surfaces. Elongated tubes and other tortuous paths are also contemplated. The heat buffer 52 operates by allowing the high heat capacity fluid to absorb heat from the cooling fluid flowing through the tubes. The fins on the tubes enhance the amount of heat transferred from the cooling fluid.

Preferably, the high heat capacity fluid should only fill the cavity in the heat buffer 52 approximately three-fourths full. Maintaining the amount of high heat capacity fluid in the cavity at less than full capacity allows agitation action of the high heat capacity fluid as the rotating frame C rotates. Such agitation can further enhance the heat transfer between the cooling fluid and the high heat capacity fluid of the heat buffer 52.

Heat is also removed from the cooling fluid of the cooling fluid loop D by the precooler/superheater 54 and the evaporator 56. More specifically, the precooler/superheater 54 and the evaporator 56 allow heat transfer between the cooling fluid loop D and the refrigeration loop E. The refrigeration loop E operates in a conventional manner using a refrigerant, preferably a compressible gas, to remove the heat from the cooling fluid passing through the precooler/superheater 54 and the evaporator 56.

The refrigeration loop E includes the precooler/superheater 54, the evaporator 56 downstream of the precooler/superheater 54 and fluidly connected thereto, a compressor 72 for receiving the refrigerant discharge from the precooler/superheater 54 and fluidly connected thereto, a condenser 74 downstream of the compressor 72 and fluidly connected thereto, and an expansion valve 76 located between the condenser 74 and the evaporator 56 and fluidly connected to the condenser 74 and the evaporator 56.

In operation, the liquid refrigerant of the refrigeration loop E vaporizes in the evaporator 56 by absorbing heat from the cooling fluid of the cooling fluid loop D. The vaporized refrigerant is dried and heated or superheated in the precooler/superheater 54 before being sent to the condenser 74 by the compressor 72. In the condenser 74, the vaporized refrigerant dissipates heat to cooling air passing through the condenser 74 and, as a result, becomes liquid refrigerant again. The liquid refrigerant returns to the evaporator 56 through the expansion valve 76 and repeats the aforementioned cycle.

The amount of heat generated by the x-ray tube varies over time. When x-rays are being generated, the amount of heat generated tends to be at or near a maximum heat loading rate. In contrast, the amount of heat generated at all other times is relatively lower. The cooling system 50 of the present invention employs the heat buffer 52 to assist in heat removal from the cooling fluid during peak heat load periods. Using the heat buffer 52 requires that the refrigeration loop E be capable of removing only an average rate of heat from the cooling fluid. The heat buffer 52 essentially queues or stores a variable portion of the heat generated by the x-ray tube B during peak loading. When the peak load period ends, the heat buffer 52 is then cooled over time by the cooling fluid in preparation for the next peak load period.

In operation during peak heat load periods, the bypass valve 60 is open. The heat buffer valve 58 is open a variable amount dependent of the temperature of the cooling fluid exiting the x-ray tube B which allows heated cooling fluid from the x-ray tube B to enter the heat buffer 52. Preferably, a thermal sensor 90 senses the cooling oil temperature and a valve controller 92 opens the valve 58 progressively more with rising temperature and progressively closes it with falling temperature. The heat buffer 52 assists the precooler/superheater 54 and the evaporator 56 in removing heat from the cooling fluid which keeps the x-ray tube B from overheating.

When the peak load period ends, i.e., the x-ray tube power is turned off, the bypass valve 60 is closed forcing all cooling fluid through the heat buffer 52. As the temperature of the cooling fluid drops below the temperature of the high heat capacity material in the heat buffer 52, it begins absorbing heat from the high heat capacity material. When the temperature of the heat buffer 52 returns to a desired temperature, the x-ray tube B may be powered again and the cycle repeated.

In an alternate embodiment, the bypass conduit 68, the bypass valve 60 and the control valve 58 are eliminated. The cooling fluid flows from the x-ray tube B directly through the heat buffer 52 during peak and off-peak heating loads. The heat buffer 52 would continue to operate as discussed above.

In yet another alternative embodiment, the precooler/superheater 54 is eliminated. The precooler/superheater 54 serves to enhance the operating efficiency of the system 50 but is not a required component.

The refrigeration loop E is sized to remove all of the heat generated by the x-ray tube over a most rapidly cycling mode of operation. The heat buffer 52 is sized to absorb the difference between the heat generated by the x-ray tube and the heat removed by the refrigeration circuit E during the longest duration cycle of the x-ray tube. When sizing the heat buffer 52, it must be remembered that the heat buffer 52 is not always brought to ambient temperature between operations of the x-ray tube. The heat buffer 52 should be sized to absorb the heat difference even when starting at the elevated temperature of a rapid on-off cycle.

The invention has been described with reference to the preferred embodiments. Obviously, modifications and alterations will occur to others upon a reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A diagnostic imaging system comprising:

an x-ray tube mounted on a rotating gantry;

an x-ray detector disposed across an imaging region from the x-ray tube; and a cooling oil circuit mounted on the rotating gantry which circulates cooling oil over the x-ray tube to remove heat from the x-ray tube thereby heating the cooling oil, the cooling oil circuit including:

a means for absorbing heat from the heated cooling oil when a high heat capacity fluid of the means is relatively less heated than the cooling oil and returning the absorbed heat back into the cooling oil when the high heat capacity fluid is relatively more heated than the cooling oil, a bypass line connected in parallel with the means for absorbing heat from the heated cooling oil, and a means for selectively adjusting a proportion of the cooling fluid directed to the means for absorbing heat from the heated cooling oil relative to a proportion of the cooling fluid directed to the bypass line.

2. The diagnostic imaging system as set forth in claim 1 further comprising:

a second cooling circuit which removes from the cooling oil circuit the heat from the x-ray tube and the absorbed heat which is returned to the cooling oil by the heat absorbing means, wherein the second cooling circuit includes:

a compressor which compresses refrigerant gas;

a condenser which condenses and cools the compressed refrigerant gas; and an evaporator in which the cooled, condensed gas evaporates to remove heat from the cooling oil.

3. The diagnostic imaging system as set forth in claim 1 wherein the means for absorbing heat from and releasing heat into the cooling oil includes:

a heat buffer through which the cooling oil is circulated, the high heat capacity fluid having a heat capacity greater than the cooling oil, the high heat capacity fluid being disposed in a heat exchanging relationship with cooling oil flowing through the heat buffer.

4. The diagnostic imaging system set forth in claim 3 wherein the heat buffer which receives the cooling fluid after absorbing heat from the x-ray tube includes:

a cavity containing the high heat capacity fluid, a cooling fluid passage passing through the high heat capacity fluid, as the cooling fluid passes through the passage, thermal heat is exchanged without fluid communication between the cooling fluid and the high heat capacity fluid, and enlarged surface area portions projecting into the passage to improve thermal communication between the cooling fluid and the high heat capacity fluid.

5. The apparatus as set forth in claim 4 wherein the enlarged surface area portions include:

a plurality of tubes with fins disposed on peripheral surfaces to increase a rate of heat transfer between the cooling fluid and the high heat capacity fluid.

6. The diagnostic imaging system as set forth in claim 2 wherein the second cooling circuit further includes:

a superheater disposed downstream of the evaporator and upstream of the compressor, the superheater fluidly connected to the evaporator and the compressor for superheating the refrigerant gas exiting the evaporator and for precooling the cooling fluid upstream of the evaporator.

7. A diagnostic imaging system comprising:

an x-ray tube;

an x-ray detector disposed across an imaging region from the x-ray tube;

a heat exchanger for removing heat from the cooling oil;

a cooling oil circuit which circulates the cooling oil from the x-ray tube to the heat exchanger and back to the x-ray tube;

a heat buffer connected in parallel with a bypass line portion of the cooling oil circuit, the heat buffer including a high heat capacity material disposed in a heat exchanging relationship with cooling oil flowing through the heat buffer;

the bypass line passing cooling oil from the x-ray tube to the heat exchanger bypassing the heat buffer; and at least one valve which controls relative proportions of cooling oil passing through the heat buffer and the bypass line.

8. The diagnostic imaging system as set forth in claim 7 wherein the cooling oil circuit further includes:

a temperature sensor which senses a temperature of the cooling oil;

a control circuit which controls the at least one valve in accordance with the sensed cooling oil temperature.

9. A cooling system for an x-ray tube of a diagnostic scanner, the cooling systems comprising:

a cooling fluid circuit which circulates cooling fluid from an x-ray tube, through a bypass line to a heat exchanger, and from the heat exchanger back to the x-ray tube;

a heat buffer connected in parallel with the bypass line, the heat buffer containing a high heat capacity material in thermal communication with the cooling fluid passing therethrough;

a valve disposed upstream of the heat buffer for controlling relative flow of the cooling fluid between the heat buffer and the bypass line; and a valve controller which adjusts the valve in accordance with a temperature of the cooling fluid to adjustably control the flow of cooling fluid into the heat buffer.

10. The apparatus as set forth in claim 9 further including a refrigeration system with a condensable gaseous refrigerant including:

an evaporator in thermal communication with the heat exchanger for cooling the cooling fluid with the refrigerant;

a compressor for receiving and compressing the refrigerant discharged from the evaporator and fluidly connected thereto;

a condenser downstream of the compressor and fluidly connected thereto; and an expansion valve located between the condenser and the evaporator.

11. The apparatus as set forth in claim 10 further including:

a precooler disposed upstream of the heat exchanger in the cooling fluid circuit and downstream of the heat exchanger in the refrigeration system for precooling the cooling fluid entering the heat exchanger with gaseous refrigerant exiting the evaporator.

12. A radiographic cooling method comprising:

intermittently operating an x-ray tube to generate x-rays and heat;

absorbing the heat generated by the x-ray tube with a cooling fluid adjacent the x-ray tube;

selectively adjusting a proportion of the cooling fluid directed to a heat buffer relative to a proportion which bypasses the heat buffer to selectively adjust a portion of the heat from the cooling fluid that is absorbed by the heat buffer while the x-ray tube is generating x-rays and heat;

cooling the heated cooling fluid;

absorbing heat from the heat buffer with the cooling fluid when the x-ray tube is not generating x-rays and heat; and recirculating the cooled cooling fluid to the x-ray tube.

13. The radioghraphic cooling method as set forth in claim 12 further including:

agitating a high heat capacity fluid that only partially fills a cavity of the heat buffer to enhance the heat transfer between the heat buffer and the cooling fluid.

14. The radiographic cooling method as set forth in claim 13 wherein the high heat capacity fluid fills a cavity in the heat buffer approximately three-fourths full.

15. A radiographic cooling method comprising:

intermittently operating an x-ray tube to generate x-rays and heat;

absorbing the heat generated by the x-ray tube with a cooling fluid;

directing a first portion of the cooling fluid to a heat buffer and bypassing a second portion of the cooling fluid around the heat buffer to absorb a portion of the heat from the cooling fluid with the heat buffer while the x-ray tube is generating x-rays and heat of the heat from the cooling fluid with the heat buffer;

adjustably regulating the first portion of the cooling fluid entering the heat buffer and the second portion bypassing the heat buffer;

cooling the first and second portions of the cooling fluid; and, recirculating the cooled cooling fluid to the x-ray tube.

* * * * *